US010773290B2

(12) United States Patent
Aigner et al.

(10) Patent No.: US 10,773,290 B2
(45) Date of Patent: Sep. 15, 2020

(54) SUPPORTING TABLE FOR BENDING MACHINE

(71) Applicant: TRUMPF Maschinen Austria GmbH & Co. KG., Pasching (AT)

(72) Inventors: Wolfgang Aigner, Sattledt (AT); Stefano Speziali, Foligno (IT); Thomas Weiss, Linz (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 302 days.

(21) Appl. No.: 15/566,005

(22) PCT Filed: Apr. 13, 2016

(86) PCT No.: PCT/AT2016/050092
§ 371 (c)(1),
(2) Date: Nov. 29, 2017

(87) PCT Pub. No.: WO2016/164948
PCT Pub. Date: Oct. 20, 2016

(65) Prior Publication Data

US 2018/0111180 A1 Apr. 26, 2018

(30) Foreign Application Priority Data

Apr. 13, 2015 (AT) ..... 50290/2015

(51) Int. Cl.
*B21D 5/00* (2006.01)
*B21D 5/04* (2006.01)
*B21D 43/00* (2006.01)

(52) U.S. Cl.
CPC ..... *B21D 5/002* (2013.01); *B21D 5/04* (2013.01); *B21D 43/003* (2013.01)

(58) Field of Classification Search
CPC . B21D 5/00; B21D 5/002; B21D 5/02; B21D 5/0281; B21D 5/04; B21D 5/042;
(Continued)

(56) References Cited

U.S. PATENT DOCUMENTS 4,501,523 A 2/1985 Haider
5,457,867 A * 10/1995 Maberry ..... A47B 88/43 29/525

(Continued)

FOREIGN PATENT DOCUMENTS

DE 196 21 658 A1 12/1997
DE 10 2006 047 109 A1 4/2008

(Continued)

OTHER PUBLICATIONS

International Search Report of PCT/AT2016/050092, dated Jul. 26, 2016.

*Primary Examiner* — Debra M Sullivan
*Assistant Examiner* — Matthew Kresse
(74) *Attorney, Agent, or Firm* — Collard & Roe, P.C.

(57) ABSTRACT

The invention relates to a bending machine (1) for metal sheets (3). The bending machine (1) comprises a machine frame (4) and a support device (15) which is designed to hold the metal sheet (3) to be bent, a support surface (16) of the support device (15) being arranged in a horizontal plane with the support surface (7) of a clamping base (5). The support device (15) has at least a first support module (17) and a second support module (18) having a first support surface (19) and a second support surface (20). At least one of the support modules (17, 18) is horizontally displaceable in the longitudinal direction (21) of the bending machine (1) and as a result a first gap (22) extending at right angles to the blank-holder edge (12) can be set between the two support modules (17, 18). The support modules (17, 18) each have at least a first support element (24) and a second support element (24, 25) with a second gap (26) located between the support elements (24, 25), which second gap (26) is oriented parallel to the blank-holder edge (12).

15 Claims, 6 Drawing Sheets

(58) Field of Classification Search
CPC ..... B21D 5/045; B21D 11/22; B21D 43/00; B21D 43/003; B21D 5/0209; B21D 43/04; B21D 43/12; B21D 43/13; B23Q 1/032; B23Q 1/25; B23Q 1/26; B23Q 1/262; B23Q 1/28; B23Q 1/282; B23Q 1/30; B23Q 1/56; B23Q 1/58; B23Q 1/60; B23Q 1/601; B23Q 1/606; B23Q 1/608; B23Q 1/62; B23Q 1/621; B23Q 1/626; B23Q 1/628; B23Q 3/00; B65G 21/14; B65G 13/12; B23P 11/00; B23P 11/02; B23P 11/027

USPC ..... 198/861.1, 817, 465.1, 346.1, 346.2; 29/281.1, 281.5, 281.6
See application file for complete search history.

(56) References Cited

U.S. PATENT DOCUMENTS

| | | | | |
|---|---|---|---|---|
| 5,630,336 | A | 5/1997 | Jorgenson | |
| 5,761,951 | A | 6/1998 | Codatto | |
| 5,979,214 | A | 11/1999 | Fetsch et al. | |
| 8,590,989 | B2 * | 11/2013 | Lowe | A47B 88/467 312/319.1 |
| 9,700,926 | B2 | 7/2017 | Codatto | |
| 2008/0072648 | A1 | 3/2008 | Kutschker | |
| 2010/0269555 | A1 * | 10/2010 | Theis | B21D 43/105 72/4 |

FOREIGN PATENT DOCUMENTS

| | | | |
|---|---|---|---|
| EP | 0 094 927 | A1 | 11/1983 |
| EP | 1 905 522 | A1 | 4/2008 |
| WO | 2013/093950 | A1 | 6/2013 |

* cited by examiner

SUPPORTING TABLE FOR BENDING MACHINE

CROSS REFERENCE TO RELATED APPLICATIONS

This application is the National Stage of PCT/AT2016/050092 filed on Apr. 13, 2016, which claims priority under 35 U.S.C. § 119 of Austrian Application No. A 50290/2015 filed on Apr. 13, 2015, the disclosure of which is incorporated by reference. The international application under PCT article 21(2) was not published in English.

The invention relates to a bending machine for metal sheets with a support device for supporting the metal sheet to be bent.

From DE 10 2006 047 109 A1 a bending machine for metal sheets is known, which comprises a supporting table with support elements which are adjustable parallel to the bending edge.

The underlying objective of the present invention is to create a bending machine which can process already preformed or bent metal sheets as variably as possible, which can perform various different bends on a metal sheet.

Said objective of the invention is achieved by the bending machine as claimed in claim 1.

According to the invention a bending machine is designed for metal sheets, in particular a pivot bending machine. The bending machine comprises:

a machine frame;

a clamping base, which is arranged on the machine frame, wherein on the clamping base a support surface is formed on which the metal sheet to be bent can be placed for processing;

a blank-holder, which is arranged to be vertically displaceable on the machine frame and by means of which in cooperation with the clamping base the metal sheet placed on the clamping base can be fixed and which blank-holder comprises on the front side a blank-holder edge extending in longitudinal direction of the bending machine;

a bending tool, which is arranged on a front side of the clamping base and the blank-holder and by means of which a metal sheet clamped between the clamping base and blank-holder can be deformed;

a support device, which is designed to hold the metal sheet to be bent, wherein a support surface of the support device is arranged in a horizontal plane with the support surface of the clamping base. The support device comprises at least one first and one second support module with a first and a second support surface, wherein at least one of the support modules can be displaced horizontally in longitudinal direction of the bending machine and in this way a gap at right angles to the blank-holder edge can be adjusted between the two support modules, and the support modules comprise respectively at least one first and one second support element with a second gap lying between the support elements, which second gap is aligned to be parallel to the blank-holder edge, wherein at least one of the support elements can be displaced so that the second gap can be adjusted in size and/or position.

An advantage of the design according to the invention is that by means of the first gap running at right angles to the blank-holder edge or by means of the second gap running parallel to the blank-holder edge, which are formed on the support device and which can be adjusted variably, metal sheets can also be placed on the support device which have already been bent and thus are not flat in the region of the support device. In this way the bending machine can be more flexible, so that a greater number of different designed metal sheets can be produced overall.

Furthermore, it can be advantageous that at least one of the two support elements comprises connected segments guided on the support module. It is an advantage in this case that segmented support elements can be moved in position as necessary and that the latter can be removed partly from the area of the supporting plane and can thereby be arranged in a space-saving manner inside the support module.

Furthermore, it is possible that for each support module at least one actuator, preferably an electric motor drive, is provided by means of which at least one of the support elements arranged on a support module can be adjusted. It is an advantage in this case that at least one of the support elements can be adjusted and thus the size of the second gap can be adjusted variably.

In one development it is possible that for each support module two actuators are provided, preferably electric motor drives, by means of which the first and the second support element can be adjusted independently of one another. It is an advantage in this case that in this way not only the size of the second gap can be adjusted variably but also the position of the second gap can be varied. The individual support modules can thus be adjusted automatically to the requirements for processing different metal sheets.

An embodiment is also advantageous in which the support elements, in particular the individual segments, can be rolled onto a storage roll. In this way it is possible that the support elements, when the latter are displaced from the supporting area and thus the second gap is increased, can be moved in the support device in a space-saving manner. By rolling the individual segments onto a storage roll the latter can be arranged on the storage roll similar to a roller shutter, thereby reducing the amount of space required.

According to one development it is possible that the storage roll is coupled by means of a belt drive to a drive unit. It is an advantage in this case that by means of the belt drive the drive unit can be spaced apart from the storage roll and thus the drive unit can be arranged in an area of the support device, in which it does not negatively affect the functionality of the support device, so that by means of the drive unit the space required for supporting the metal sheet is not restricted.

Furthermore, it can be advantageous that the storage rolls are coupled rotatably by at least two of the support modules, wherein the rotary movement is transmitted by means of a drive shaft extending in longitudinal direction with a polygonal cross-section and wherein the drive shaft is driven by means of a rotary drive and wherein the storage rolls can be displaced in longitudinal direction of the drive shaft. It is an advantage here that a drive shaft with a polygonal cross-section can be arranged on the bending machine, which is driven by a drive unit. The individual support modules can hereby be arranged displaceably in longitudinal direction on the bending machine, the storage rolls having a polygonal inner cross-section which corresponds with the polygonal cross-section of the drive shaft. In this way a torque-transmitting connection can be formed between the storage rolls and the drive shaft, wherein longitudinal displacement is possible between the drive shaft and the storage rolls.

Furthermore, the support modules can be displaced by means of a manipulator in the longitudinal direction of the bending machine, wherein the manipulator comprises a coupling element for coupling as necessary to the support modules. It is an advantage here that in this way the first gap can be adjusted automatically in size and/or in position and thus the bending machine can be adjusted for processing various differently designed metal sheets.

Furthermore, it is possible for the manipulator to have a manipulator arm which is designed so that the manipulator can reach different support modules. It is an advantage hereby that a manipulator, used for manipulating metal sheet workpieces, can also be used for positioning the individual modules.

According to one particular embodiment it is possible for the manipulator to comprise a tensioning device with a carrier element. It is an advantage here that a manipulator of this kind can be designed as simply as possible and can extend over the whole width of the bending machine so that all of the support modules of the support device can be displaced by means of the manipulator.

In an alternative variant it is possible for each of the support modules to have its own actuator and be displaced by the latter in the longitudinal direction of the bending machine. It is an advantage here that the support modules can be displaced simultaneously and independently of one another and thus support devices can be prepared within a very short time period for supporting variously shaped metal sheets. In this way the set-up time can be shortened and thus the capacity of the bending machine can be increased.

According to one advantageous development is possible for each support module to have an emergency brake, by means of which the support module can be fixed in position. It is an advantage here that in this way the individual support modules can be fixed in position and in this way the unwanted displacement of the support modules can be prevented.

In particular, it can be an advantage that the individual segments of the support elements are coupled to one another by an elastic coupling element. In this way it is possible for the individual segments of the support elements to be joined to one another flexibly.

Lastly, it is possible that the individual segments of the support elements each comprise a roller guide by means of which they are guided in a support module. It is an advantage here that the individual segments of the support elements can thus be guided smoothly in a support module, wherein such a roller guide is only subjected to low levels of wear.

For a better understanding of the invention the latter is explained in more detail with reference to the following Figures.

In a much simplified, schematic view.

Figure 1:
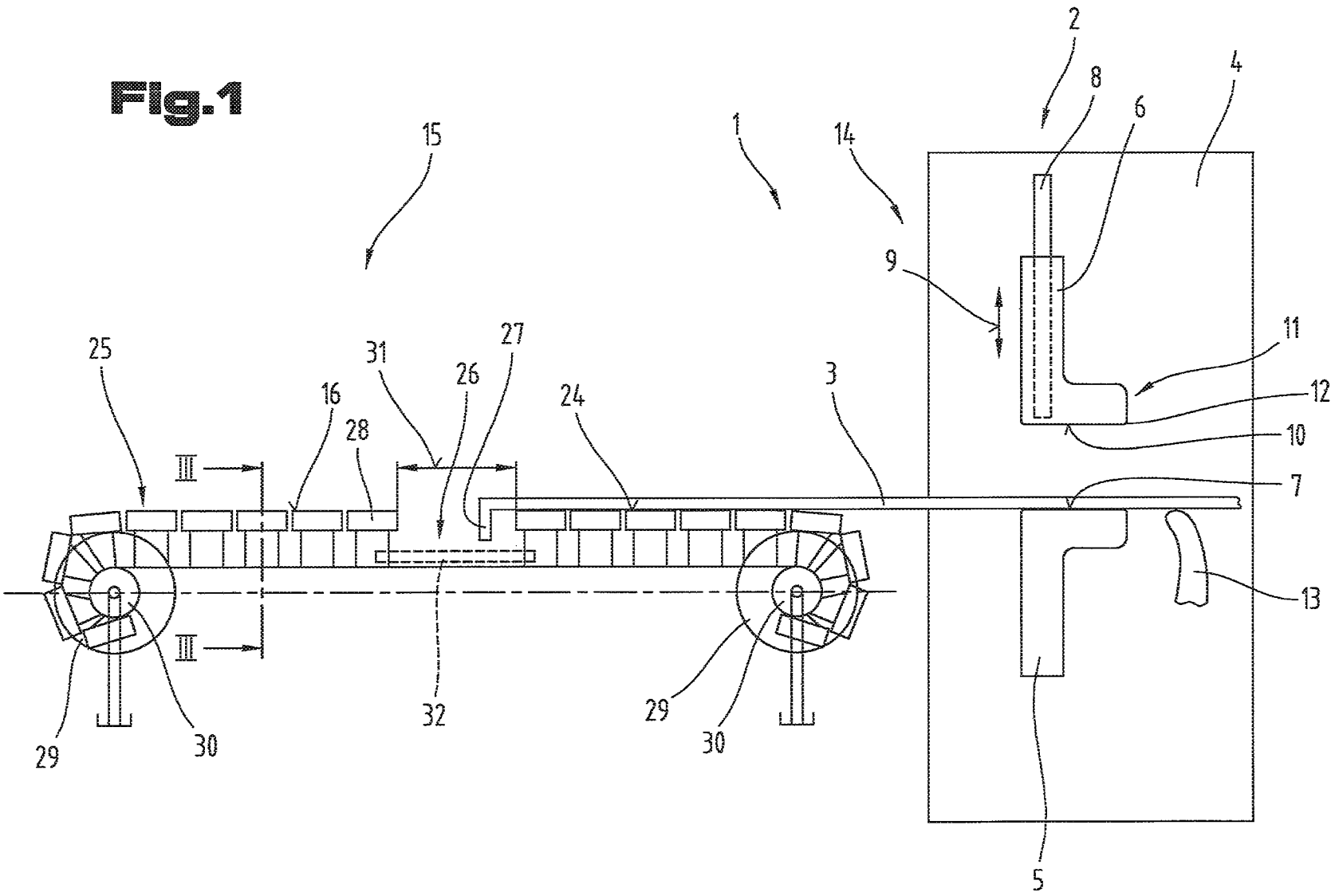
FIG. 1 is a side view of a bending machine with a support device.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

Figure 2:
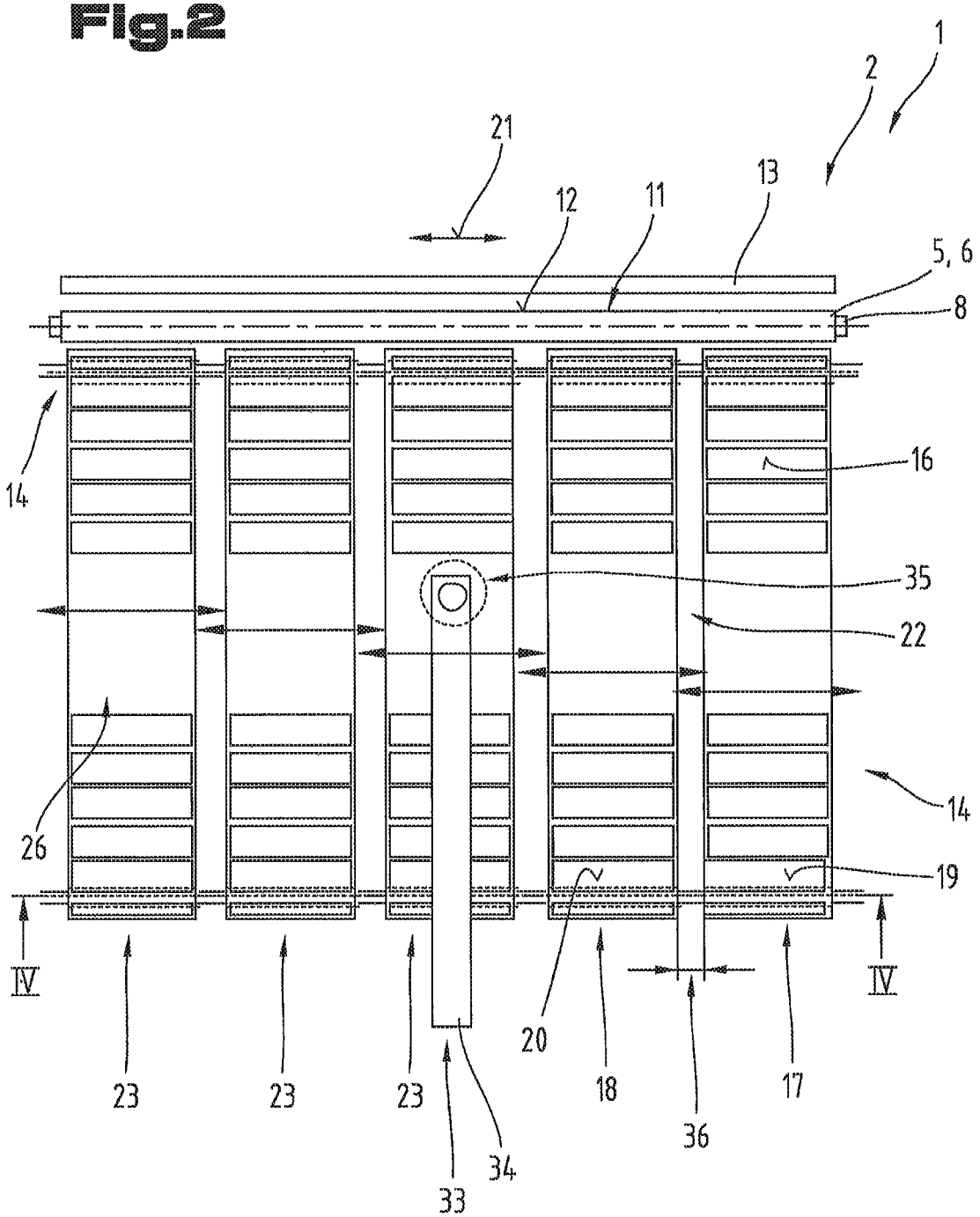
FIG. 2 is a plan view of the bending machine with the support device.

FIG. 1 shows in a schematic representation a side view of a bending machine 1. FIG. 2 shows in schematic view a plan view of the bending machine 1. The structure of the bending machine 1 is described in the following with reference to an overview of FIGS. 1 and 2.

As shown clearly in FIGS. 1 and 2 the bending machine 1 is designed as a pivot bending machine 2 which is used for bending metal sheets 3. The bending machine 1 comprises a machine frame 4, on which a clamping base 5 and a blank-holder 6 are arranged. The clamping base 5 can be connected rigidly, i.e. not movably, to the machine frame 4 and is used for supporting the metal sheet 3. In particular, on the clamping base 5 a support surface 7 is formed on which the metal sheet 3 can be supported.

The blank-holder 6 can be arranged displaceably on the machine frame 4 in vertical direction by a guide rail system 8 9. On the underside the blank-holder 6 can have a blank-holder surface 10 which is provided for contacting the metal sheet 3.

On the front side 11 of the blank-holder 6 a blank-holder edge 12 is formed which can be used as a bending edge with the workpiece. The blank-holder surface 10 is delimited on the front side 11 of the blank-holder 6 by the blank-holder edge 12.

To perform a bending process the metal sheet 3 to be bent is clamped between the clamping base 5 and the blank-holder 6. On the front side 11 of the blank-holder 6 a bending tool 13 is arranged by means of which the clamped metal sheet 3 can be bent.

On the rear side 14 of the blank-holder 6 or the clamping base 5 a support device 15 is formed which is used for supporting the metal sheet 3. The support device 15 has a support surface 16 on which the metal sheet 3 to be bent is supported or can be mounted. The support surface 16 of the support device 15 is preferably aligned in a plane with the support surface 7 of the clamping base 5, so that a metal sheet 3 placed on the clamping base 5 and the support device 15 lies horizontally on the latter.

The support device 15 comprises a first support module 17 and a second support module 18, which form a first support surface 19 and a second support surface 20. The support surface 16 of the support device 15 is thus formed in particular by the first support surface 19 and/or the second support surface 20. In other words the first support surface 19 and the second support surface 20 are part of the support surface 16.

At least one of the two support modules 17, 18 can be displaced horizontally in longitudinal direction 21 of the bending machine 1. The longitudinal direction 21 of the bending machine 1 is aligned to be parallel to the blank-holder edge 12.

By means of the first support module 17 or the second support module 18, in particular its limited first support surface 19 or second support surface 20, a first gap 22 is formed which is located between the first support module 17 and second support module 18. The first gap 22 is at right angles to the blank-holder edge 12.

In addition to the first support module 17 or the second support module 18 it is possible for a further support module 23 to be formed which is designed in the same way as the first or second support module 17, 18. Furthermore, a plurality of additional support modules 23 can be arranged on the support device 15.

Furthermore, it is possible that at least one of the support modules 17, 18, 23 has a first support element 24 and a second support element 25, by means of which in particular the support surfaces 19, 20 are formed. Between the two support elements 24, 25 a second gap 26 is formed which is aligned to be parallel to the blank-holder edge 12. The second gap 26 can be varied by displacing the first support element 24 and/or by displacing the second support element 25 in position and in size.

By means of the described configuration of the support modules 17, 18, 23 it is possible for the metal sheets 3, which have a prebent tab 27, to be placed flat on the support device 15. This is achieved in particular in that the tab 27 can be mounted in the second gap 26.

Furthermore, by means of the design of the support device 15 with displaceable support modules 17, 18, 23 it is possible that a tab 27 can also be mounted in the first gap 22 between the individual support modules 17, 18, 23.

The tab 27 can be arranged by means of the highly variable configuration of the bending machine 1 either parallel to the bending edge of the metal sheet section to be bent, at right angles thereto or at a wider angle therefrom.

As shown in FIGS. 1 and 2 it is possible that the two support elements 24, 25 are formed by individual segments 28. The individual segments 28 can hereby be rolled similarly to a roller shutter onto a storage roll 29 and can thus be displaced in a space-saving manner.

Furthermore, it is possible that for each support module 17, 18, 23 an actuator 30 is provided by means of which at least one of the support elements 24, 25 arranged on a support module 17, 18, 23 can be adjusted. The actuator 30 can be designed as a rotary drive, such as an electric motor rotary drive, e.g. a servomotor. By means of the actuator 30 it is possible for the second gap 26 to be adjusted at least in size or position. In this way a gap width 31 of the second gap 26 can be controlled.

According to a first embodiment variant it is possible for two actuators 30 to be provided for each support module 17, 18, 23, by means of which the first 24 and the second support element 25 can be adjusted independently of one another. In this way the position or the gap width 31 of the second gaps 26 can be varied freely.

In a further embodiment variant it is possible for the first support element 24 and the second support element 25 to be coupled to one another by a connecting element 32 and thus be adjustable by a common actuator 30. In this case the gap width 31 can be adjusted in advance and during the automatic operation of the support device 15 by means of one actuator 30 only the position of the second gap 26 can be varied and the gap width 31 remains constant.

According to another alternative variant the support elements 24, 25 cannot be adjusted by an actuator 30 but the latter can be adjusted manually.

The actuator 30 can be torque-coupled to the storage roll 29 by various different connecting means. Different connecting means are explained in more detail in the following in the individual FIGS. 3 to 7.

To displace the individual support modules 17, 28, 23 in longitudinal direction 21 a manipulator 33 can be provided which can be controlled by the machine control. The manipulator 33 can have a manipulator arm 34 on which a coupling element 35 can be formed which is used for coupling the manipulator arm 34 to the individual support modules 17, 18, 23. The manipulator 33 can be used to adjust the gap width 36 of the first gap 22.

Furthermore, the manipulator arm 34 can be designed for manipulating metal sheets 3. In a further alternative variant the support elements 24, 25 can be adjusted by the manipulator arm 34 and thus the second gap 26 and the second gap width 31 can be adjusted.

Figure 3:
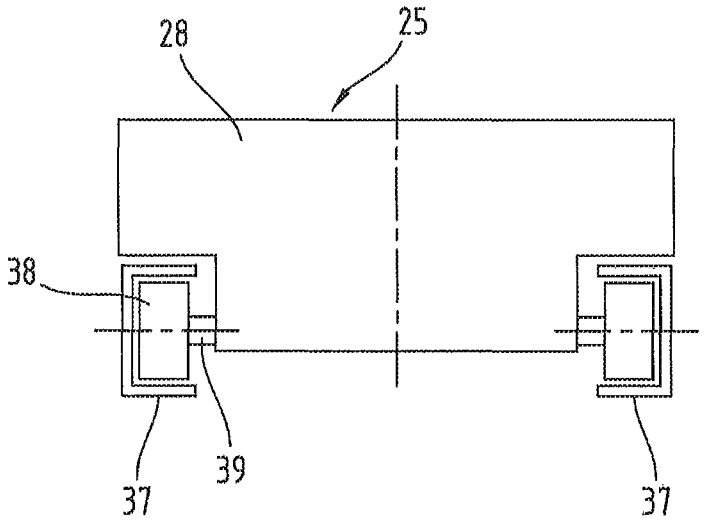
FIG. 3 is a cross-sectional view of the support device, in particular according to the section line III-III of FIG. 1.

FIG. 3 shows a further and possibly independent embodiment of the bending machine 1, wherein the same reference numerals and component names have been used for the same parts as in the preceding FIGS. 1 and 2. To avoid unnecessary repetition reference is made to the detailed description in the preceding FIGS. 1 and 2.

FIG. 3 shows in schematic representation an example of a cross-section of a support module 17, 18, 23 according to the section line III-III according to FIG. 1.

In the embodiment in FIG. 3 it is possible that the individual support elements 25 or similarly the support elements 24 can be guided in a guide rail 37 and can thereby be displaceable. For example, it is possible for the individual segments 28 to each have a guide roller system 38 by means of which the latter are guided or mounted in the guide rail 37. The guide roller system 38 can be formed for example by a roller with an inner bearing which is connected to the segment 28 by means of an axial pin 39. Preferably, two guide rails 37 are positioned relative to one another such that the latter also provide lateral support to the support element 25 guided thereby.

Alternatively to the embodiment variant with a guide roller system 38 a sliding guide can be formed, wherein a sliding element can engage in the guide rail 37. The sliding element can be designed for example as a sliding block which is mounted in the guide rail 37.

Figure 4:
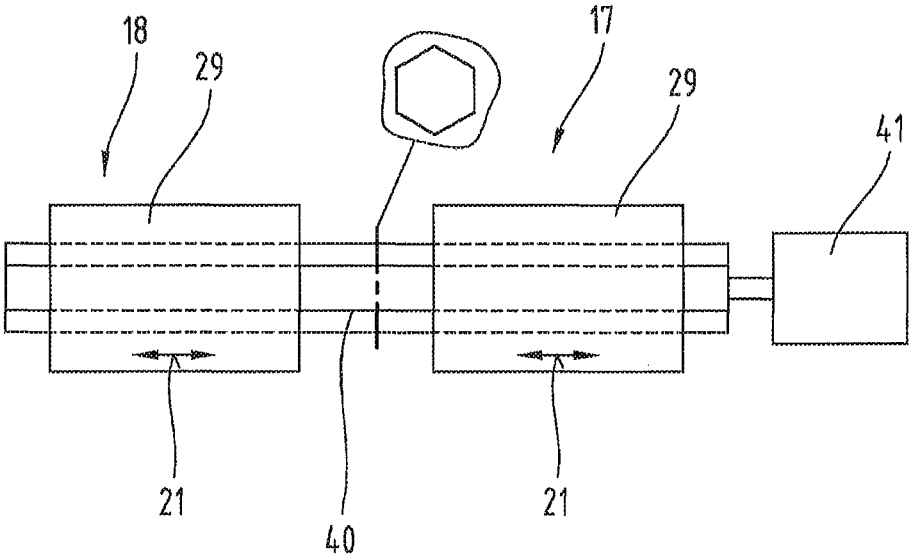
FIG. 4 is a cross-sectional view of the support device in the area of the storage roll, in particular according to the section line IV-IV of FIG. 2.

FIG. 4 shows a further and possibly independent embodiment of the bending machine 1, wherein the same reference numerals and component names have been used for the same parts as in the preceding FIGS. 1 to 3. To avoid unnecessary repetition reference is made to the detailed description of the preceding FIGS. 1 to 3.

FIG. 4 shows a cross-sectional view according to section line IV-IV of FIG. 2, wherein the cross-section runs through the center of the storage rolls 29. The view according to FIG. 4 shows the drive situation of the storage rolls 29.

In the embodiment according to FIG. 4 a drive shaft 40 is formed which runs through the center of the storage rolls 29 and the storage rolls 29 are torque-coupled to the drive shaft 40. The torque-coupled embodiment can be achieved in that the drive shaft 40 has a polygonal external contour and the storage rolls 29 have a polygonal inner contour corresponding with said external contour for example. By means of said polygonal carrier profile the storage rolls 29 can be displaced individually in longitudinal direction 21 relative to the drive shaft 40. The drive shaft 40 can be coupled to a rotary drive 41, which can be arranged at the side of the support modules 17, 18 and can be used for the joint drive of the individual storage rolls 29 of the support modules 17, 18.

Figure 5:
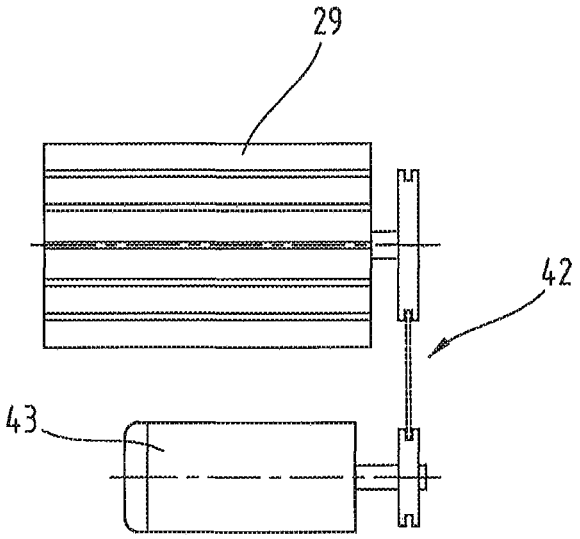
FIG. 5 is a cross-sectional view of a further embodiment of the support device with a belt drive.
Figure 6:
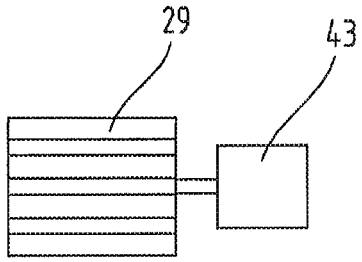
FIG. 6 is a cross-sectional view of a further embodiment of the support device with a direct drive.
Figure 7:
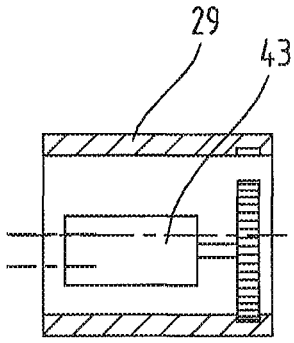
FIG. 7 is a cross-sectional view of a further embodiment of the support device with a hub motor.

FIGS. 5, 6 and 7 show additional and possibly independent embodiments of the bending machine 1, wherein the same reference numerals and component names are used for the same parts as in the preceding FIGS. 1 to 4. To avoid unnecessary repetition reference is made to the detailed description of the preceding FIGS. 1 to 4.

FIG. 5 shows a further embodiment of the possible drive of a storage roll 29, wherein this Figure shows that a belt drive 42 can be formed which is driven by a drive unit 43. It is hereby possible that for each storage roll 29 a drive unit 43 is provided which drives the latter. In an alternative variant it is also possible for a drive unit 43 to be formed for driving a plurality of storage rolls 29.

FIG. 6 shows a further embodiment of a way of coupling a storage roll 29 to a drive unit 43, wherein in this embodiment the drive unit 43 is connected directly by a shaft connection to the storage roll 29.

FIG. 7 shows a further possible embodiment of the arrangement of the drive unit 43 for the storage roll 29. The storage roll 29 is designed as a hollow body and the drive unit 43 is arranged like a wheel hub motor inside said hollow body. By means of an inner toothing in the storage roll 29 or by means of a gearwheel connected accordingly to the drive unit 43 the torque is thus transmitted from the drive unit 43 to the storage roll 29.

Figure 8:
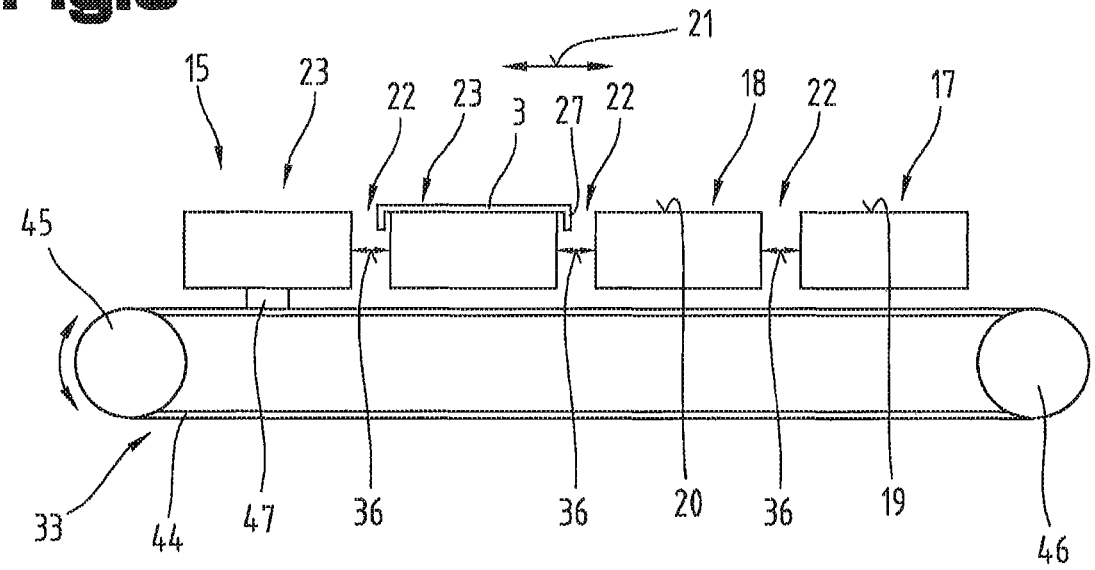
FIG. 8 is a side view of a further embodiment of the support device with a belt drive for the support modules.

FIG. 8 shows a further and possibly independent embodiment of the bending machine 1, wherein the same reference numerals and component names are used for the same parts as in the preceding FIGS. 1 to 7. To avoid unnecessary repetition reference is made to the detailed description of the preceding FIGS. 1 to 7.

FIG. 8 shows in a schematic representation a cross-sectional view of the support device 15, in particular according to section line IV-IV of FIG. 2. FIG. 8 shows the individual modules 17, 18, 23, wherein this Figure shows that a metal sheet 3 to be bent which is placed on one or more of the modules, can have side tabs 27, which can project into the first gap 22. To adjust the gap width 36 of the first gap 22 a tensioning device 44 can be provided which is tensioned for example by a drive roller 45 and a deflecting roller 46 and on which a carrier element 47 is arranged which can be coupled to the individual support modules 17, 18, 23 in order to adjust the latter. The tensioning device 44 can be designed for example in the form of a belt drive. In particular a toothed belt can be used for the tensioning device 44.

Figure 9:
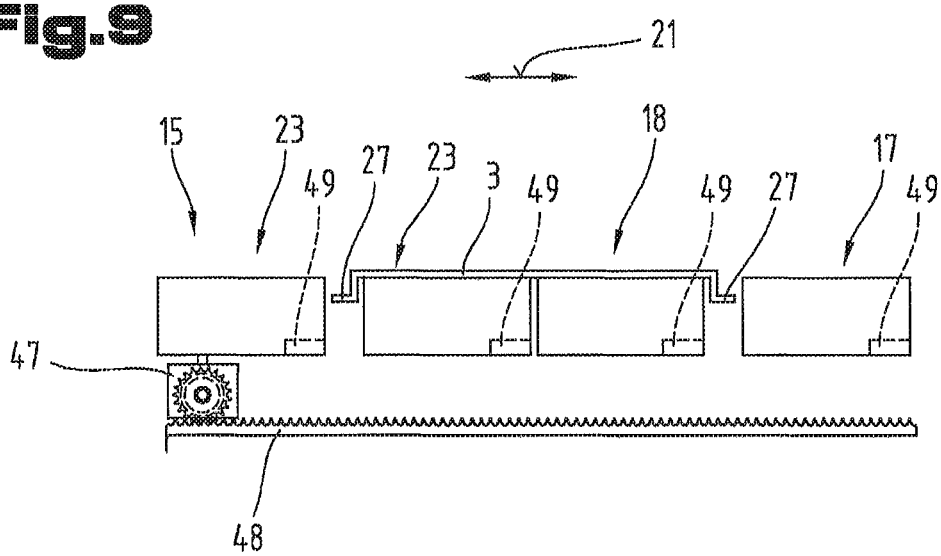
FIG. 9 is a side view of a further embodiment of the support device with a gear rack for the support modules.

FIG. 9 shows a further and possibly independent embodiment of the bending machine 1, wherein the same reference numerals and component names have been used for the same parts as in the preceding FIGS. 1 to 8. To avoid unnecessary repetition reference is made to the detailed description of the preceding FIGS. 1 to 8.

FIG. 9 shows a further embodiment of the structure of the support device 15, wherein a view according to FIG. 8 has been selected. As shown clearly in FIG. 9 the manipulator 33 can be designed in the form of a carrier element 47 which is guided on the support device 15 and engages in a gear rack 48, whereby the carrier element 47 can be displaced in longitudinal direction 21. The carrier element 47 can be here optionally coupled to the individual support modules 17, 18, 23. In this way, the gap width 36 of the first gap 22 can be adjusted, similar to the embodiment according to FIG. 8.

Both in the embodiment according to FIG. 8 and in the embodiment according to FIG. 9 one or more of the support modules 17, 18, 23 can have an emergency brake 49, by means of which the latter can be fixed in position.

Figure 10:
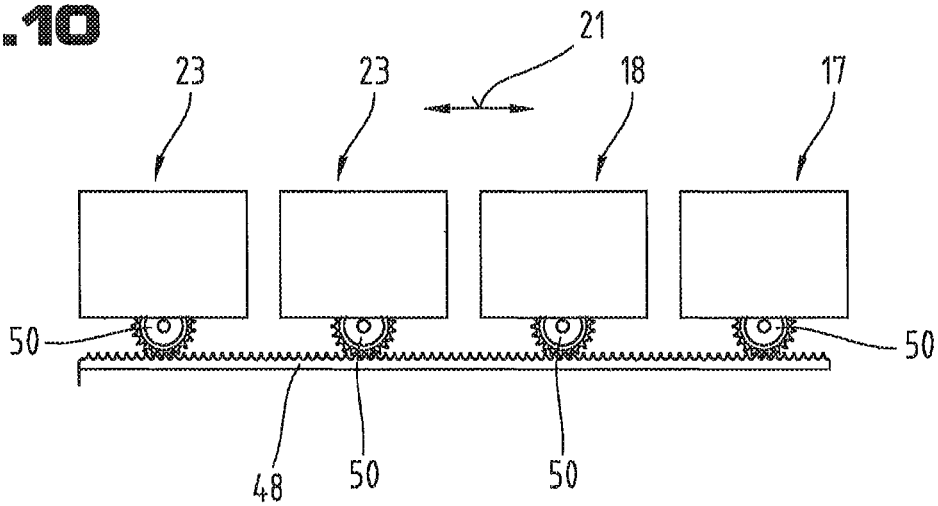
FIG. 10 is a side view of a further embodiment of the support device with a direct drive for the support modules.

FIG. 10 shows a further and possibly independent embodiment of the bending machine 1, wherein the same reference numerals and component names are used for the same parts as in the preceding FIGS. 1 to 9. To avoid unnecessary repetition reference is made to the detailed description of the preceding FIGS. 1 to 9.

In this embodiment for each support module 17, 18, 23 an actuator 50 is provided which is used for adjusting the support modules. In this way the support modules 17, 18, 23 can be adjusted at the same time and independently of one another in longitudinal direction 21.

Figure 11:
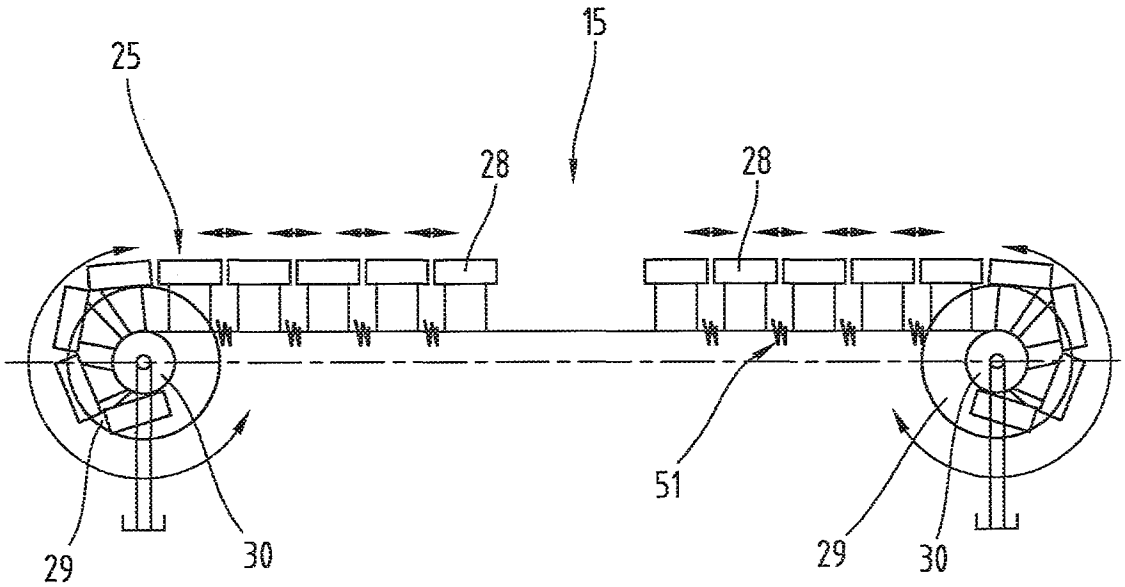
FIG. 11 is a side view of a further embodiment of the support device with an elastic coupling of the segments.

FIG. 11 shows a further and possibly independent embodiment of the bending machine 1, wherein the same reference numerals and component names are used for the same parts as in the preceding FIGS. 1 to 10. To avoid unnecessary repetition reference is made to the detailed description of the preceding FIGS. 1 to 10.

In this embodiment the individual segments 28 of the first support element 24 and/or the second support element 25 are coupled to one another by means of an elastic coupling element 51. The elastic coupling element 51 can be formed for example by a rubber element.

The control of the drive units for the individual driving moments for controlling the gap width 36 of the first gap 22 and/or the gap width 31 of the second gap 26 can be performed by a central computer unit which is also used for controlling the bending process of the bending machine 1.

The embodiments show possible embodiment variants of the bending machine 1, wherein it should be noted at this point that the invention is not restricted to the specifically shown embodiment variants thereof, but rather various different combinations of the individual embodiment variants are possible and this variability due to the teaching on technical procedure of the present invention is within the skillset of an expert in this technical field.

Furthermore, also individual features and combinations of features of the various different shown and described embodiments can in themselves represent independent solutions according to the invention.

The problem addressed by the independent solutions according to the invention can be taken from the description.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

Mainly the individual embodiments shown in FIGS. 1, 2, 3; 4; 5; 6, 7; 8, 9, 10 and 11 can form the subject matter of independent solutions according to the invention. The objectives and solutions according to the invention relating thereto can be taken from the detailed descriptions of these figures.

Finally, as a point of formality, it should be noted that for a better understanding of the structure of the bending machine 1 the latter and its components have not been represented to scale in part and/or have been enlarged and/or reduced in size.

| List of reference numerals | |
|---|---|
| 1 | bending machine |
| 2 | pivot bending machine |
| 3 | metal sheet |
| 4 | machine frame |
| 5 | clamping base |
| 6 | blank-holder |
| 7 | support surface of clamping base |
| 8 | guide rail system |
| 9 | vertical direction |

-continued

| List of reference numerals | |
|---|---|
| 10 | blank-holder surface |
| 11 | front side |
| 12 | blank-holder edge |
| 13 | bending tool |
| 14 | rear side |
| 15 | support device |
| 16 | support surface of the support device |
| 17 | first support module |
| 18 | second support module |
| 19 | support surface of first support module |
| 20 | support surface of second support module |
| 21 | longitudinal direction |
| 22 | first gap |
| 23 | additional support module |
| 24 | first support element |
| 25 | second support element |
| 26 | second gap |
| 27 | tab |
| 28 | segment |
| 29 | storage roll |
| 30 | actuator |
| 31 | gap width of second gap |
| 32 | connecting element |
| 33 | manipulator |
| 34 | manipulator arm |
| 35 | coupling element |
| 36 | gap width of first gap |
| 37 | guide rail |
| 38 | guide roller system |
| 39 | axle pin |
| 40 | drive shaft |
| 41 | rotary drive |
| 42 | belt drive |
| 43 | drive unit |
| 44 | tensioning device |
| 45 | drive roller |
| 46 | reversing roller |
| 47 | carrier element |
| 48 | gear rack |
| 49 | emergency brake |
| 50 | actuator |
| 51 | elastic coupling element |

The invention claimed is:

1. A bending machine for a metal sheet, comprising:

a machine frame;

a clamping base arranged on the machine frame, wherein on the clamping base a support surface is formed, wherein the metal sheet to be bent can be placed on the support surface for processing;

a blank-holder arranged to be vertically displaceable on the machine frame, wherein the metal sheet when placed on the clamping base can be fixed using the blank-holder in cooperation with the clamping base, and wherein the blank-holder on a front side of the blank-holder has a blank-holder edge extending in a longitudinal direction of the bending machine;

a bending tool arranged on a front side of the clamping base and the blank-holder, wherein using the bending tool the metal sheet when clamped between the clamping base and the blank-holder can be shaped;

a support device designed for supporting the metal sheet to be bent, wherein the support device comprises at least one first support module with a first support surface and one horizontally displaceable second support module comprising at least one first support element with a first support element support surface and one second support element with a second support element support surface, wherein the horizontally displaceable second support module has a width extending in the longitudinal direction, wherein the first support surface and the first and second support element support surfaces are arranged in a horizontal plane with the support surface of the clamping base, wherein the horizontally displaceable second support module is displaceable horizontally in the longitudinal direction of the bending machine and in this way a first gap running at right angles to the blank-holder edge can be adjusted between the first and second support modules, wherein a second gap is between the first and second support elements, wherein the second gap is aligned parallel to the blank-holder edge, wherein the second gap is configured such that a prebent tab of the metal sheet is positionable in the second gap, wherein the second gap is in a form of a recess that extends entirely over the width of the second support module in a transverse direction transverse to the longitudinal direction, and wherein at least one of the first and second support elements can be displaced at right angles to the blank-holder edge so that the second gap can be adjusted in size and/or position.

2. The bending machine as claimed in claim 1, wherein at least one of the first and second support elements comprises connecting segments guided on the second support module.

3. The bending machine as claimed in claim 2, wherein the connecting segments of the first and second support elements are coupled to one another by means of an elastic coupling element.

4. The bending machine as claimed in claim 2, wherein the connecting segments of the first and second support elements each have a roller guide, and wherein the roller guide is configured to guide the connecting segments in the second support module.

5. The bending machine as claimed in claim 1, wherein for each of the first and second support modules, at least one actuator is arranged, wherein the at least one actuator of the second support module is configured to adjust at least one of the first and second support elements arranged on the second support module.

6. The bending machine as claimed in claim 1, wherein for each of the first and second support modules, first and second actuators are arranged, and wherein the first and second actuators, are configured to adjust the first support element and the second support element independently of one another.

7. The bending machine as claimed in claim 1, further comprising a storage roll, wherein the support elements can be rolled onto the storage roll.

8. The bending machine as claimed in claim 7, wherein the storage roll is coupled by means of a belt drive to a drive unit.

9. The bending machine as claimed in claim 1, further comprising a plurality of storage rolls, wherein the storage rolls are rotationally coupled by at least the first and second support modules, wherein the rotary movement is transmitted by means of a drive shaft with a polygonal cross-section extending in the longitudinal direction of the bending machine, wherein the drive shaft is driven by means of a rotary drive, and wherein the storage rolls can be displaced in a longitudinal direction of the drive shaft.

10. The bending machine as claimed in claim 1, further comprising a manipulator, wherein the manipulator displaces the first and second support modules in the longitudinal direction of the bending machine, and wherein the manipulator has a coupling element for coupling to the first and second support modules.

11. The bending machine as claimed in claim 10, wherein the manipulator comprises a manipulator arm designed such that the manipulator can reach the first and the second support modules.

12. The bending machine as claimed in claim 10, wherein the manipulator comprises a tensioning device with a carrier element.

13. The bending machine as claimed in claim 1, wherein each of the support modules has a separate actuator configured to displace the respective support module in the longitudinal direction of the bending machine.

14. The bending machine as claimed in claim 1, wherein for each support module there is an emergency brake, wherein the emergency brake is configured to fix the support module in position.

15. A bending machine for a metal sheet, comprising:

a machine frame;

a clamping base arranged on the machine frame, wherein on the clamping base a support surface is formed, wherein the metal sheet to be bent can be placed on the support surface for processing;

a blank-holder arranged to be vertically displaceable on the machine frame, wherein the metal sheet when placed on the clamping base can be fixed using the blank-holder in cooperation with the clamping base, and wherein the blank-holder on a front side of the blank-holder has a blank-holder edge extending in a longitudinal direction of the bending machine;

a bending tool arranged on a front side of the clamping base and the blank-holder, wherein using the bending tool the metal sheet when clamped between the clamping base and the blank-holder can be shaped;

a support device designed for supporting the metal sheet to be bent, wherein the support device comprises at least one first support module with a first support surface and one horizontally displaceable second support module, wherein each of the at least one first support module and the second support module comprises at least one first support element with a first support element support surface and one second support element with a second support element support surface, wherein each of the at least one first support module and the second support module has a respective width extending in the longitudinal direction, wherein the first support surface and the first and second support element support surfaces are arranged in a horizontal plane with the support surface of the clamping base, wherein the horizontally displaceable second support module is displaceable horizontally in the longitudinal direction of the bending machine and in this way a first gap running at right angles to the blank-holder edge can be adjusted between the first and second support modules, wherein a second gap is between the first and second support elements, wherein the second gap is aligned parallel to the blank-holder edge, wherein the second gap is configured such that a prebent tab of the metal sheet is positionable in the second gap, wherein the second gap is in a form of a recess that extends entirely over the width of the respective support module in a transverse direction transverse to the longitudinal direction, and wherein at least one of the first and second support elements can be displaced at right angles to the blank-holder edge so that the second gap can be adjusted in size and/or position.

* * * * *